United States Patent [19]

Panknin et al.

[11] 4,176,536

[45] Dec. 4, 1979

[54] DEVICE FOR PRODUCING A BEAD ON THE CIRCUMFERENCE OF A HOLLOW CYLINDER

[75] Inventors: Walter Panknin; Kurt Finsterwalder, both of Göppingen; Reinhard Kannegiesser, Birenbach; Hans Bässler, Eislingen, all of Fed. Rep. of Germany

[73] Assignee: L. Schuler GmbH, Fed. Rep. of Germany

[21] Appl. No.: 925,296

[22] Filed: Jul. 17, 1978

[30] Foreign Application Priority Data

Jul. 16, 1977 [DE] Fed. Rep. of Germany ..... 2732263

[51] Int. Cl.[2] ..... B21D 19/06

[52] U.S. Cl. ..... 72/91; 72/105; 113/120 AA

[58] Field of Search ..... 72/91, 94, 105; 113/120 AA

[56] References Cited

U.S. PATENT DOCUMENTS

| | | | |
|---|---|---|---|
| 3,967,488 | 7/1976 | Hasselbeck et al. | 113/120 AA |
| 4,070,888 | 1/1978 | Gombas | 72/91 |

*Primary Examiner*—Lowell A. Larson
*Attorney, Agent, or Firm*—Craig and Antonelli

[57] ABSTRACT

A device for producing a bead on a circumference of a hollow cylinder seeks to minimize the risk of unwanted deformations of the hollow cylinder such as wrinkles or bulges which can result when an area of the hollow cylinder to be beaded is forced inward without support. In a preferred embodiment, the device of producing a bead on a hollow cylinder includes an internal tool and an external tool which can be adjusted in a controlled manner in the radial direction, the internal tool comprising a support mandrel and an inner ring which is adjacent to the supporting mandrel in the axial direction and is capable of being adjusted radially relative thereto, and the external tool includes an outer ring which surrounds the inner ring and a hold-down ring which is axially adjacent the outer ring and capable of being adjusted radially relative thereto. A preferred arrangement utilizes axially oriented springs whose forces are deflected radially inwards by tapered ring surfaces and assure proper relative movements of the several radially shiftable parts.

7 Claims, 3 Drawing Figures

DEVICE FOR PRODUCING A BEAD ON THE CIRCUMFERENCE OF A HOLLOW CYLINDER

BACKGROUND AND SUMMARY OF THE INVENTION

The invention relates to a device for producing a bead on the circumference of a hollow cylinder and is intended to include the production of a bead in general and also the production of a contraction (with or without flange) or a flange at the end of a hollow cylinder.

In known devices of this type (DT-PS 750 476, DT-OS 22 18 396) the internal and the external tool are in each case constructed functionally in one piece. This means that in the known devices, as the production of the bead progresses, the area of the hollow cylinder to be beaded is forced inward without support by the internal tool, whereas the area of the hollow cylinder adjoining the area to be beaded remains without support by the external tool and consequently may be forced to bulge outwards. These two circumstances may, either singly or more particularly taken together, lead to unwanted deformations of the hollow cylinder, in particular to the development of wrinkles and bulges.

The problem of the invention is to obviate the risk of the occurrence of these unwanted deformations, or at least to moderate this risk substantially and thereby to obtain an improvement in the quality of the beaded hollow cylinder.

This problem is solved in a device according to the present invention. An advantageous effect as achieved by a preferred embodiment resides in the fact that as the production of the bead proceeds, the inner ring supports the area to be beaded from within, while a holding-down ring supports the adjoining area from the outside. In this arrangement the radial adjustments of the holding-down ring relative to the outer ring and of the inner ring relative to the supporting mandrel, which are correspondingly necessary for this purpose, can be derived directly, by way of suitable adjusting means, from the drive for the device.

A relatively simple construction for the device according to the present invention results if the radial adjustments are derived only indirectly from the drive for the device. This can be through the fact that radially acting springs urge the inner ring and the supporting mandrel on the one hand and the outer ring and the hold-down ring on the other hand into coaxial positions relative to one another. Then, with a reduced radial distance of the outer ring from the axis of the supporting mandrel as the production of the bead progresses, under the pressure of the outer ring acting radially from the outside, the inner ring yields radially inwards relative to the supporting mandrel, while under the pressure of the supporting mandrel acting radially from the inside, the hold-down ring yields radially outwards relative to the outer ring.

In a preferred embodiment of the device according to the present invention wherein the external tool can be adjusted radially inwards relative to the internal tool in opposition to the force of a spring acting radially outwards, as known per se (DT-PS 750 476), that is to say there is derived directly from the drive for the device only a radially inwardly directed adjustment of the external tool relative to the internal tool, a construction wherein the spring arrangements include springs which are disposed in the axial direction and wherein means for deflecting their forces are formed by pairs of tapered ring surfaces surrounding the axis of the supporting mandrel gives a particularly simple and compact arrangement.

The radial adjustments which have been described may also be effected in opposition to the forces of suitably disposed cylinder-piston units, while it is also possible according to another embodiment of the invention to obtain a particularly simple and compact construction if the cylinder-piston units are disposed axially and the forces are diverted into the radial direction by way of pairs of tapered rings surrounding the axis of the supporting mandrel.

Should sections of the hollow cylinder adjoin the area of the hollow cylinder to be beaded in both axial directions, that is to say a bead in the narrower sense is to be produced, the supporting mandrel and the holding-down ring may, according to the invention, have sections extending in both axial directions from the inner ring or the outer ring.

The device according to the invention can be applied both in the single arrangement known per se (DT-PS 750 476) and also in the multiple arrangement known per se (DT-OS 22 18 396) with a plurality of internal and external tools disposed radially on a tool carrier with rotary drive, in which arrangement, in the latter case, it is convenient if the controlled radial adjustability of the external tools relative to the internal tools is derived from the drive by means of a controlling cam which partially surrounds the tool carrier.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE INVENTION

Figure 1:
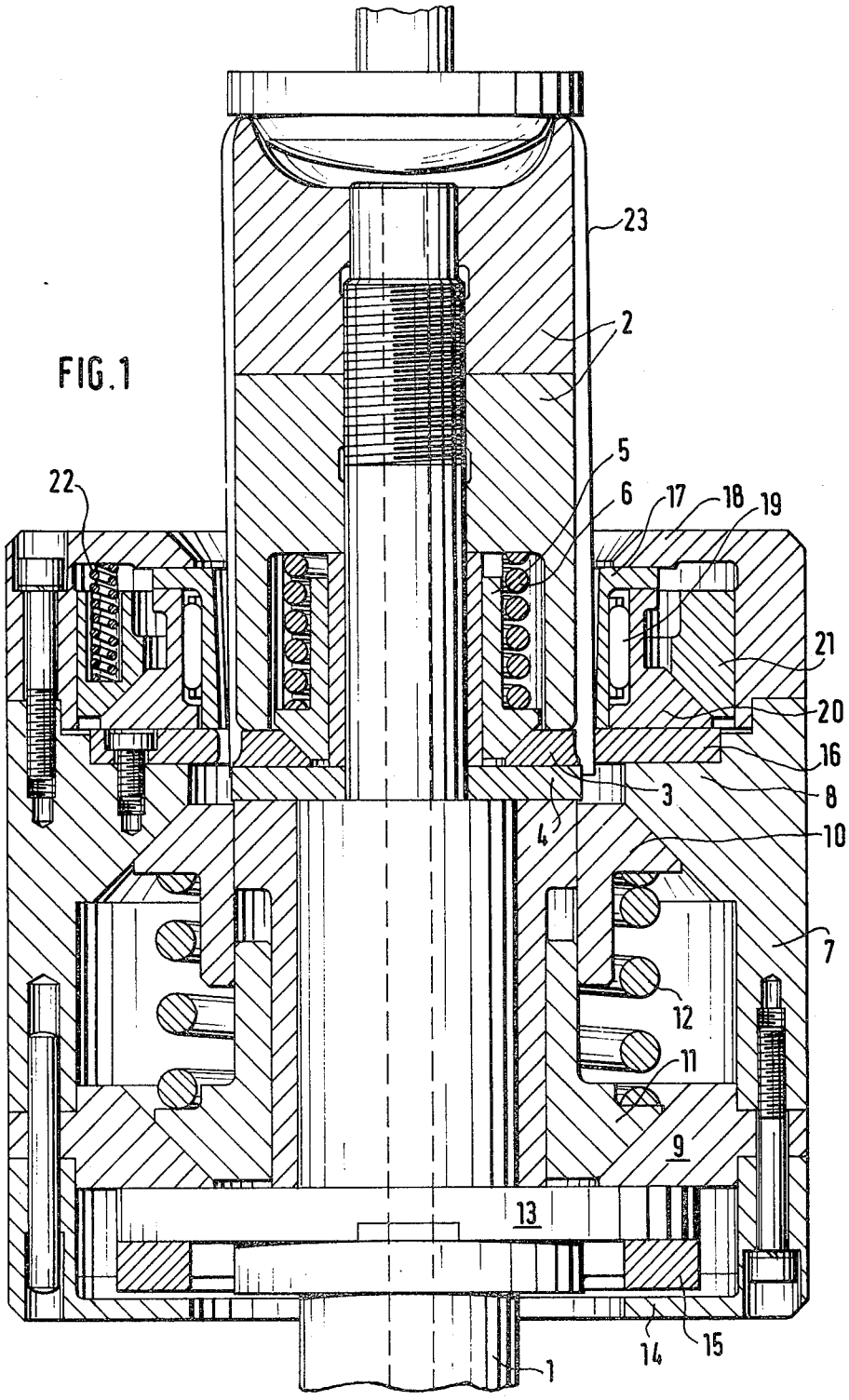
FIG. 1 is a cross-sectional view of a preferred embodiment in the position before the start of a production of a bead.

A tool carrier (now shown in the drawings) mounts a tool spindle 1 and itself is acted upon by a rotary drive (likewise not represented in the drawings). Fixed on the tool spindle 1 is a supporting mandrel 2 which rotates with the tool spindle 1. Adjoining the supporting mandrel 2 in the axial direction there is an inner ring 3 mounted for radial adjustment on the tool spindle 1 and likewise rotating with the tool spindle 1. The inner ring 3 is guided axially between a collar 4 on the tool spindle 1 and the supporting mandrel 2. The inner ring 3 has an inner tapered ring surface which co-operates with an outer tapered ring surface which is provided on a sleeve 5 which is slidably axially on the tool spindle 1 and likewise rotates with the latter. The sleeve 5 is acted upon by an axially disposed spring 6 supported on the other side on the supporting mandrel 2, which spring urges the sleeve 5 in the direction of the collar 4 and hence also the inner ring 3 into a position coaxial with the supporting mandrel 2.

Also mounted on the tool spindle 1, so as to be immovable axially and adjustable radially, is a circular housing 7 which surrounds a section of the tool spindle. On two inner ring discs 8, 9 respectively the housing 7 has an inner tapered ring surface, the two tapered ring surfaces being inclined in opposite directions to one another. Co-operating with the inner tapered ring surfaces on the inner ring discs 8, 9 are outer tapered ring surfaces, inclined in opposite directions to one another, which are provided on two clamping sleeves 10, 11 which are slidable axially on the tool spindle 1 and relative to one another. The two clamping sleeves 10, 11 are acted upon by a coil spring 12, disposed axially between the two clamping sleeves 10, 11 which urges the two clamping sleeves apart in the axial direction and hence also the housing 7 into a position coaxial with the tool spindle 1. The two clamping sleeves 10, 11 and the coil spring 12 rotate together with the tool spindle 1.

Inside the housing 7 the tool spindle 1 is provided with a driving disc 13 against the face of which, turned towards the supporting mandrel 2, rests, so as to be driven, the surface of rear ring disc 9 which faces away from the supporting mandrel. Mounted free between the rear face of the driving disc 13 remote from the supporting mandrel 2 and a rear end wall 14 of the housing 7 is a driving ring 15 by means of which the rotary drive is transmitted from the tool spindle 1 to the housing 7. To this end the driving ring 15 has, on the side facing the supporting mandrel 2, two sliding blocks which engage in a groove in the rear face of the driving disc 13 and, on the side remote from the supporting mandrel 2, two sliding blocks which engage in a groove in the rear end wall 14 of the housing 7, both grooves—viewed in the axial direction—extending at right-angles to one another. The housing 7 is guided on the tool spindle 1 on the one hand by the mounting of the driving disc 13 between the rear inner ring disc 9 and the driving ring 15 which is braced on the rear end wall 14 of the housing 7 and on the other hand by the two pairs of tapered ring surfaces between the two ring discs 8, 9 and the two clamping sleeves 10, 11.

Fixed on the housing 7 on the side of the front ring disc 8 facing the supporting mandrel 2 is an outer ring 16. Next to the outer ring 16 in the axial direction and freely mounted is a hold-down ring 17 which is guided axially between the outer ring 16 and a front end wall 18 of the housing 7. The hold-down ring 17 is braced radially by way of a needle bearing 19 on a thrust ring 20 which surrounds the latter on the outside. The thrust ring 20 has an outer tapered ring surface which co-operates with an inner tapered ring surface on a tapered ring 21. The tapered ring 21 can slide axially in the housing 7 and is acted upon by compression springs 22, axially disposed and braced on the other side on the front end wall 18 of the housing 7, which urge the tapered ring 21 towards the outer ring 16 and hence also the thrust ring 20 and the hold-down ring 17 into a position coaxial with the outer ring 16. The outer ring 16, the thrust ring 20, the tapered ring 21 and the compression springs 22 rotate together with the housing 7, whereas the hold-down ring 17 can rotate differently, by way of the needle bearing 19.

The manner of operation of the above-described device consists in the fact that in the position before the start of production of a bead (FIG. 1) an unbeaded hollow cylinder 23 is pushed in the axial direction over the supporting mandrel 2, the inner ring 3 and a part of the collar 4. The whole device then rotates together with the unbeaded hollow body 23 under the action of the rotary drive to the tool spindle 1. Production of the bead is started by, for example, the introduction, by way of a rolling contact bearing (not shown in the drawings) surrounding the housing on the outside, of a progressive, radial adjustment of the housing 7 relative to the tool spindle 1.

Figure 2:
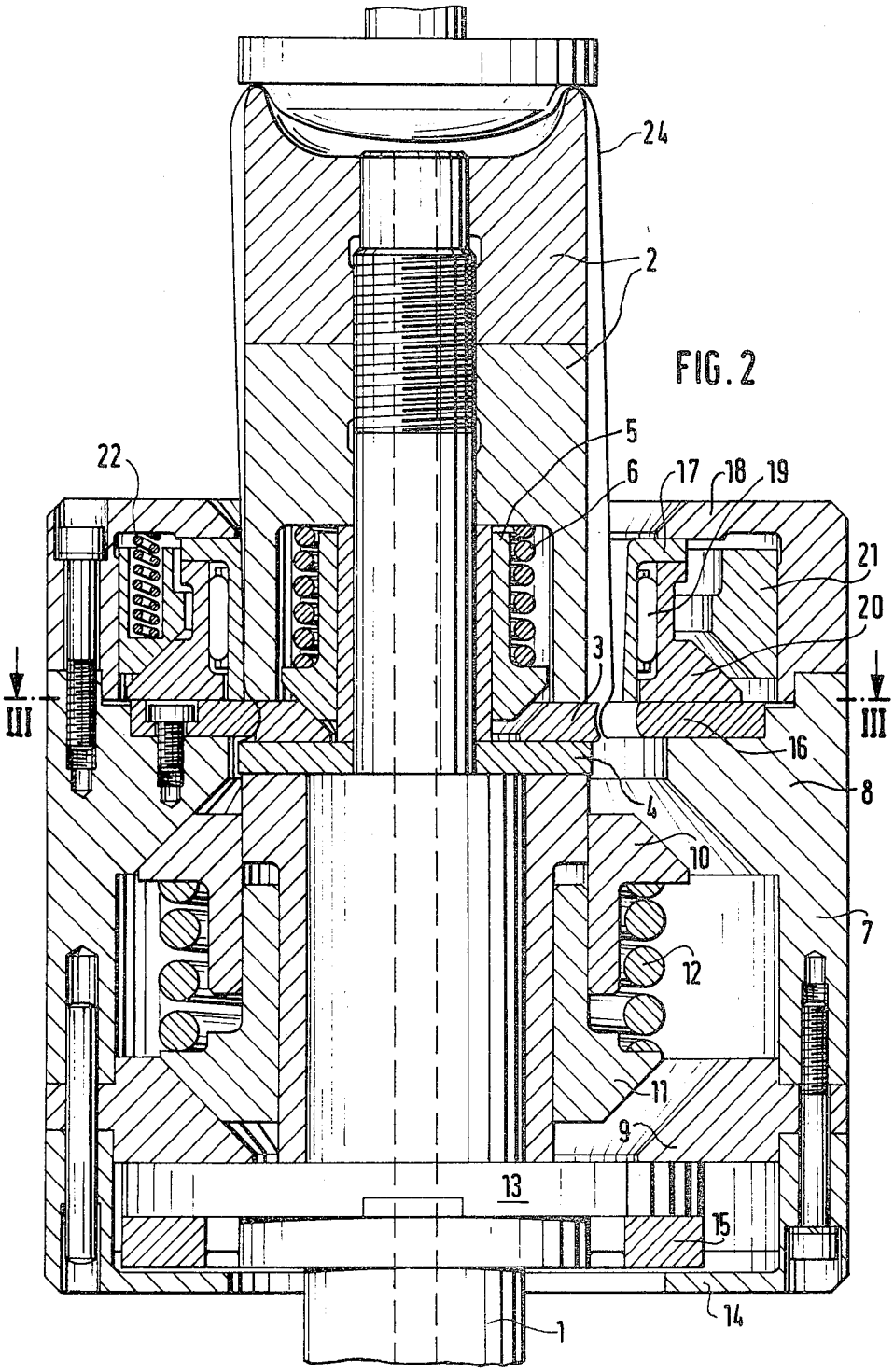
FIG. 2 is a cross-sectional view of the preferred embodiment in the position on completion of production of a bead.
Figure 3:
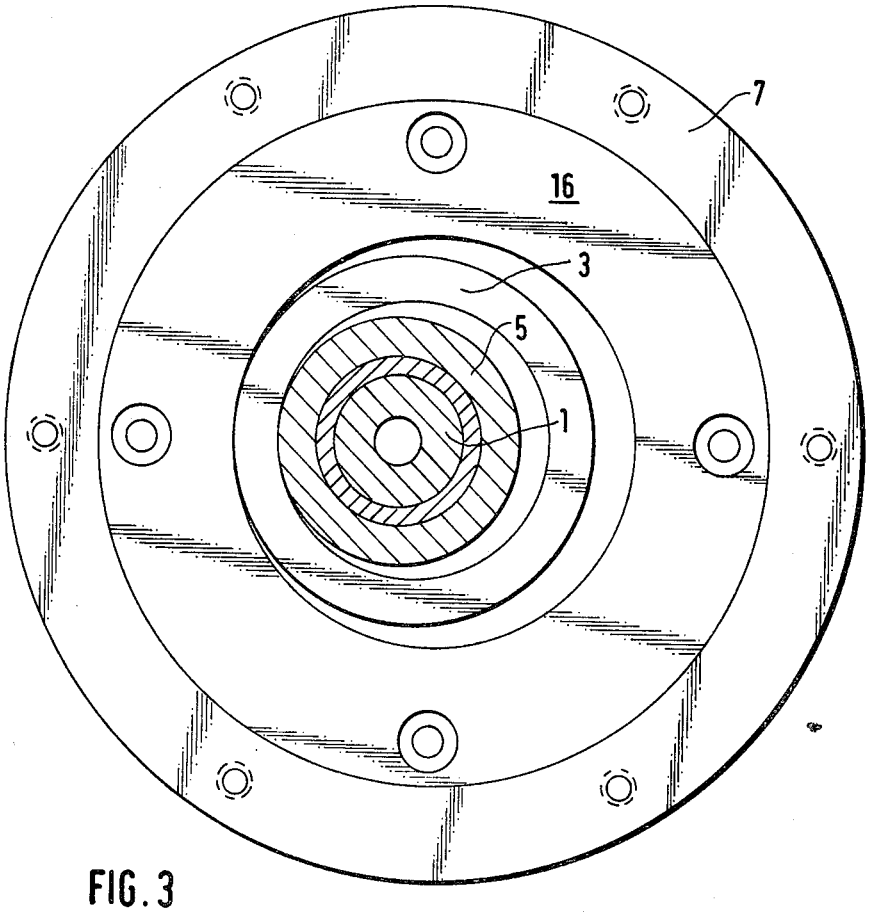
FIG. 3 is a section taken along line III—III in FIG. 2.

As a result, on the side of the tool spindle 1 on which the housing 7 is brought close to the tool spindle 1, the hold-down ring 17 comes to bear on the supporting mandrel 2 over the unbeaded hollow cylinder 23 and the outer ring 16 comes to bear on the inner ring 3 over the area of the unbeaded hollow cylinder 23 which is to beaded. As the radial adjustment of the housing 7 proceeds further the inner ring 3 is adjusted radially relative to the supporting mandrel in the direction of the adjustment of the housing and the hold-down ring 17 is radially adjusted relative to the outer ring 16 in the opposite direction, until the radial adjustment is concluded, when the production of the bead is ended and the beaded hollow cylinder 24 is produced (FIG. 2). During production of the bead the section of the hollow body 23 which at the start was pushed over the collar 4 has been drawn into the bead. Because of the differing generating radii of the outer ring 16 on the radially adjusted inner ring 3 and of the radially adjusted hold-down ring 17 on the supporting mandrel 2, the needle bearing has the function of making it possible for the rotational speed of the hold-down ring 17 to be different from that of the housing 7.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Device for producing a bead extending over a circumference of a hollow cylinder, such as a can body, with a circular, rotatable internal tool, of which the outer diameter is smaller than the inner diameter of the hollow cylinder after it has been beaded, and with a rotatable external tool in the form of a circular ring, of which the inner diameter is greater than the outer diameter of the unbeaded hollow cylinder, and the area of the hollow cylinder to be beaded can be rolled and deformed between the outer periphery of the internal tool and the inner periphery of the external tool and the external tool can be adjusted in a controlled manner in the radial direction, characterized in that the internal tool comprises a supporting mandrel and an inner ring, said inner ring being adjacent the supporting mandrel in the axial direction and being capable of being adjusted radially relative thereto, and the external tool comprises an outer ring surrounding the inner ring and a hold-down ring, said hold-down ring being adjacent the outer ring in the axial direction and being capable of being adjusted radially relative thereto.

2. Device according to claim 1, characterized in that the hold-down ring can be adjusted radially outwards relative to the outer ring against the force of a spring arrangement acting to bias said hold-down ring radially inward.

3. Device according to claim 1 or 2, characterized in that the inner ring can be adjusted radially inwards relative to the supporting mandrel against the force of a second spring arrangement acting to bias said inner ring radially outwards.

4. Device according to claim 3, wherein the external tool can be adjusted radially inwards relative to the internal tool against the force of a third spring arrangement acting to bias said external tool radially outwards, characterized in that the spring arrangements include springs which are disposed in the axial direction and wherein means for deflecting their forces are formed by pairs of tapered ring surfaces surrounding the axis of the supporting mandrel.

5. Device according to claim 1, characterized in that at least one cylinder-piston unit is provided, respectively, which is acted upon by a pressure medium and against the forces of which the external tool can be adjusted radially inwards relative to the internal tool, the hold-down ring can be adjusted radially outwards relative to the external ring and the inner ring can be adjusted radially inwards relative to the supporting mandrel.

6. Device according to claim 1, wherein said supporting mandrel is positioned coaxially with respect to said external tool in an unbeaded hollow cylinder mounting position and wherein said external tool is mounted so as to be displaced eccentrically with respect to said mandrel during formation of a bead upon said cylinder.

7. Device according to claim 4, wherein said supporting mandrel is positioned coaxially with respect to said external tool in an unbeaded hollow cylinder mounting position and wherein said external tool is mounted so as to be displaced eccentrically with respect to said mandrel during formation of a bead upon said cylinder.

* * * * *